US008959722B2

(12) United States Patent
Allen, Sr.

(10) Patent No.: US 8,959,722 B2
(45) Date of Patent: Feb. 24, 2015

(54) APPARATUS FOR COMFORTABLY HANGING KEYS AND OTHER KEY-RING ACCESSORIES WITHIN A SLASH-TYPE CLOTHING POCKET

(71) Applicant: Dennis Grey Allen, Sr., Raleigh, NC (US)

(72) Inventor: Dennis Grey Allen, Sr., Raleigh, NC (US)

( * ) Notice: Subject to any disclaimer, the term of this patent is extended or adjusted under 35 U.S.C. 154(b) by 211 days.

(21) Appl. No.: 13/689,202

(22) Filed: Nov. 29, 2012

(65) Prior Publication Data

US 2013/0139357 A1 Jun. 6, 2013

Related U.S. Application Data

(60) Provisional application No. 61/565,954, filed on Dec. 1, 2011.

(51) Int. Cl.
*A45F 5/02* (2006.01)
*A44B 15/00* (2006.01)

(52) U.S. Cl.
CPC ..... *A45F 5/022* (2013.01); *A44B 15/00* (2013.01); *A45F 2200/0558* (2013.01)
USPC ..... 24/3.6; 24/3.12; 24/369; 24/370; 224/269; 70/458

(58) Field of Classification Search
CPC ..... A45F 5/022; A45F 5/02; A45F 5/021
USPC ..... 24/3.6, 3.12, 369, 370; 224/269; 70/458
See application file for complete search history.

(56) References Cited

U.S. PATENT DOCUMENTS 2,634,470 A * 4/1953 De Grafft, Jr. ..... 24/3.13
2,777,180 A * 1/1957 Keating et al. ..... 24/3.6

* cited by examiner

*Primary Examiner* — Jack W Lavinder

(57) ABSTRACT

A key-hook comfortably hangs keys and other key-ring accessories within a clothing pocket, which prevents the keys and other key-ring accessories from contacting and wearing out the bottom of the clothing pocket. The key-hook includes a key-ring loop, a curved bridge, and a hook. The hook is connected to the key-ring loop by the curved bridge, which allows the edge of the clothing pocket to smoothly move against the key-ring loop and into the hook. The hook has a shank section, a bend section, a point section, and a gap. The edge of the clothing pocket is positioned within the gap and is embraced by the shank section, the bend section, and the point section. The shank section has a first concave portion, and the point section has a second concave portion, a convex portion, and a rounded tip. The gap also has a wide opening and a narrow space.

1 Claim, 6 Drawing Sheets

APPARATUS FOR COMFORTABLY HANGING KEYS AND OTHER KEY-RING ACCESSORIES WITHIN A SLASH-TYPE CLOTHING POCKET

The current application claims a priority to the U.S. Provisional Patent application Ser. No. 61/565,954 filed on Dec. 1, 2011.

FIELD OF THE INVENTION

The present invention generally relates to an apparatus that hangs keys and/or other artifacts for convenient access. More specifically, the present invention with affixed keys or artifacts (such as, but not limited to, tools) can be attached to clothing, bags, luggage, or other structures (examples of other structures includes fences, the edge of a workbench, and a key-rack).

BACKGROUND OF THE INVENTION

When keys are kept in a trouser pocket, the keys tend to wear out the bottom of the trouser pocket. Keys within a trouser pocket can also be an annoyance to the wearer because the keys would swing back and forth and would rub against the wearer's body. In addition, the current means of hanging keys from the trousers are done in a cumbersome and unsightly manner. One current means of hanging keys from a pair of trousers is through the use of a chain, which attaches one end to the waistband/waist-belt and attaches the other hooked end to a belt, a belt loop, or the waistband/waist-belt. The chain dangles the keys from the pair of trousers and allows the keys to swing back and forth, which can become a nuisance. Alternatively, one end of the chain could also be attached to the waistband/waist-belt and the other end of chain could be placed within the trouser pocket while the keys hang from the chain within the trouser pocket. Another means of hanging keys from a pair of trousers is a simple leather/nylon loop that is attached to the belt. The loop also dangles the keys from the pair of trouser and allows the keys to swing back and forth, which can become a nuisance like the chain. Another means of hanging keys from a pair of trousers is to use a lobster clasp that is attached to a belt loop. Similar to the chain and the simple leather/nylon loop, the lobster clasp is a nuisance because the keys dangle from the lobster clasp and are able to swing back and forth. Another means of hanging keys from a pair of trousers is to use a clip with a retraction system, which retracts the keys when the keys are pulled away from the pair of trousers. The retraction system holds the keys closer to the pair of trousers in order to reduce the amount of swinging by the keys, but the retraction system cannot completely stop the keys from moving. Another means of hanging keys from a pair of trousers is a light weight replica of a climbing carabineer, which is usually attached to a belt loop. The climbing carabineer has the same swinging problem with the keys as the chain, the loop, and the lobster clasp. Other means of securing keys to a pair of trousers is an enclosure for the keys, which is kept in one of the trouser's pockets. The enclosure can be designed with a variety of configurations such as a simple rubbery plastic pouch with a slit opening or a more sophisticated and expensive pouch that is made of leather/vinyl and has individual inner hooks. The enclosure eliminates the swinging problem for the keys, but the enclosure can be bulky and inconvenient to use.

Therefore, the objective of the present invention is to provide an apparatus to secure keys to a pair of trousers and to not allow the keys to swing back and forth on the pair of trousers.

Primarily, the present invention is a small, lightweight, and unobtrusive apparatus that is typically used to hang keys within a trouser pocket. The present invention hangs the keys above the other contents of the trouser pocket. The present invention allows the keys to remain hidden within the trouser pocket until the keys are needed. The present invention is particularly designed to hang from the strong point of the trouser pocket, which is at the intersection of the trouser pocket and the outer seam of a trouser leg. The present invention provides an apparatus that can be used for a variety of secondary objectives such as hanging the keys outside of the trouser pocket, hanging the keys from a belt loop, hanging the keys from the belt, or hanging other articles from any clothing item.

DETAIL DESCRIPTIONS OF THE INVENTION

All illustrations of the drawings are for the purpose of describing selected versions of the present invention and are not intended to limit the scope of the present invention.

Figure 1:
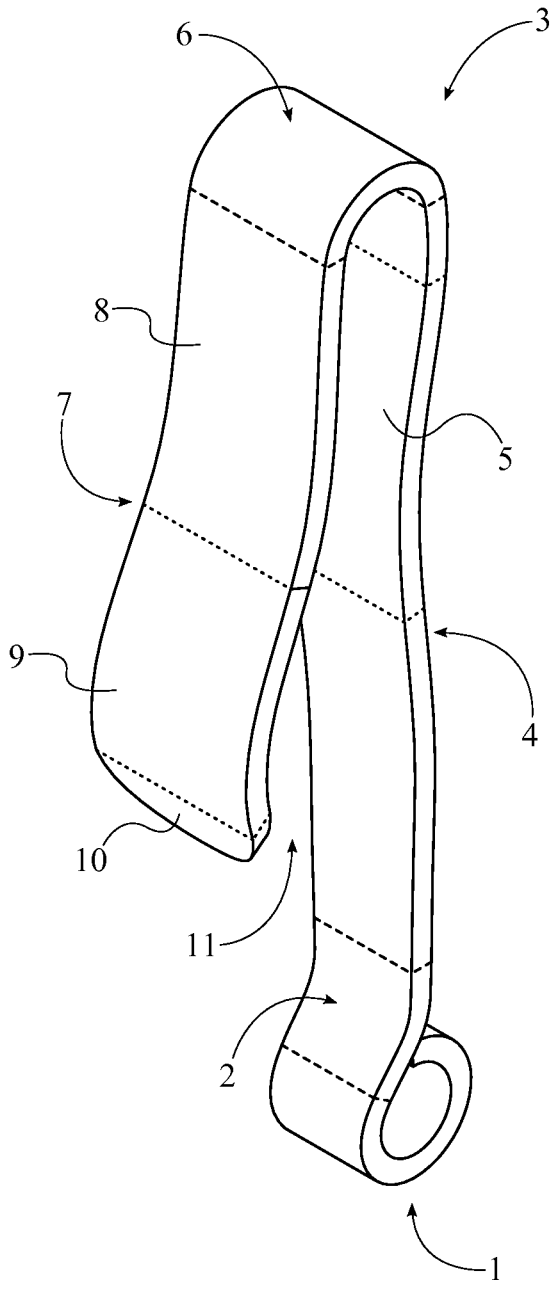
FIG. 1 is a perspective view of the present invention.
Figure 4:
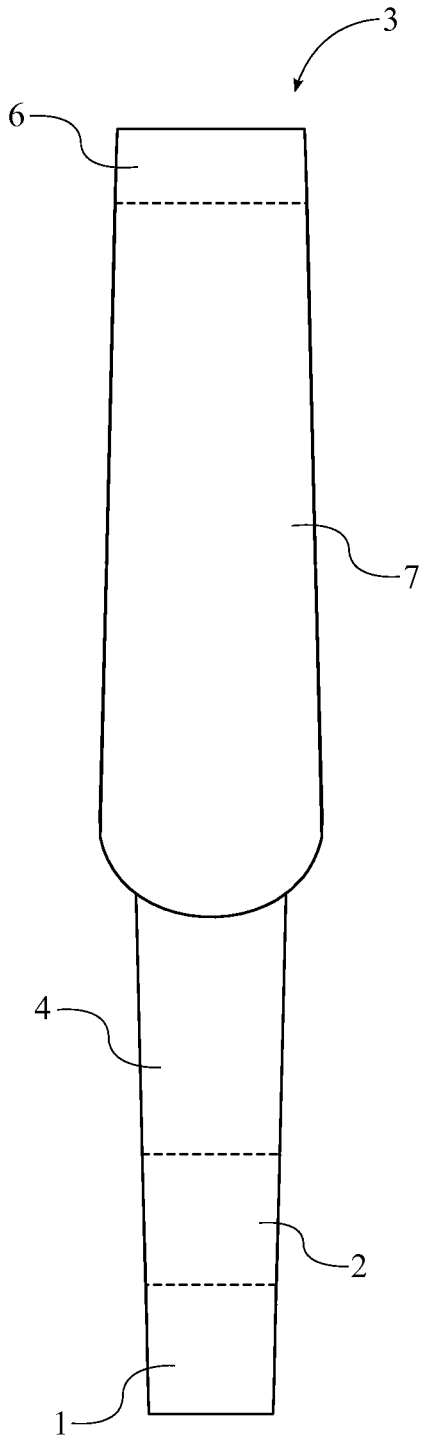
FIG. 4 is a front view of the present invention.
Figure 5:
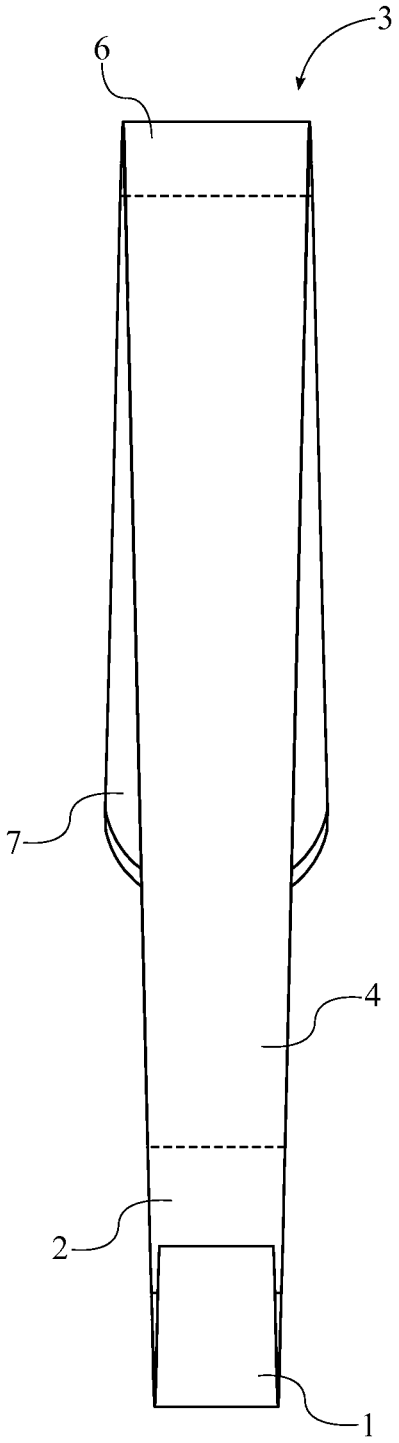
FIG. 5 is a back view of the present invention.

As can be seen in FIG. 1, the present invention is an apparatus for comfortably hanging keys and other key-ring accessories from a slash-type clothing pocket. The present invention can also be hung from any part of a piece of clothing, handbags, bags, satchels, tool belts, key storage boards, tool storage boards, luggage, or any other structure. The present invention mainly comprises a key-ring loop 1, a curved bridge 2, and a hook 3, which are shown in FIGS. 4 and 5. The key-ring loop 1 allows keys and other key-ring accessories to be coupled to the present invention through at least one key-ring or a split ring. The present invention can also be coupled to keys or other key-ring accessories by a wire, string, or chain. In the preferred embodiment, the key-ring loop 1 has a radius of approximately 1.5 millimeters. The hook 3 allows the present invention to physically hang those keys and other key-ring accessories within a slash-type pocket and, thus, prevents those keys and other key-ring accessories from scraping the bottom of the slash-type pocket. The hook 3 is ergonomically designed to hang at the lower corner of the edge for a slash-type pocket so that the present invention stabilizes and prevents those keys and other key-ring accessories from moving around in the slash-type pocket. The lower corner of the edge for a slash-type pocket is usually where the outer seam of the pant leg intersects the reinforced top of the slash-type pocket, which can be found on any pair of short pants, pants, cover-alls, overalls, or trousers. The curved bridge 2 is used to easily slide the present invention onto the edge of a slash-type pocket.

The configuration between the key-ring loop 1, the curved bridge 2, and the hook 3 allows the present invention to hang keys and other key-ring accessories on the edge of a slash-type pocket. The present invention is lightweight and unobtrusive because of the simple configuration of the key-ring loop 1, the curved bridge 2, and the hook 3. In order to properly describe this configuration, the hook 3 must further comprise a shank section 4, a bend section 6, a point section 7, and a gap 11, which are also shown in FIGS. 4 and 5. The shank section 4 is a long shaft for the hook 3. The length of the shank section 4 determined how deep the keys or the other key-ring accessories will hang within the slash-type pocket. Consequently, the key-ring loop 1 is adjacently connected to the shank section 4 by the curved bridge 2, which allows the edge of a slash-type pocket to smoothly move across the key-ring loop 1 and into the hook 3. The bend section 6 is used to brace the present invention against the edge of a slash-type pocket once the edge of the slash-type pocket moves into the hook 3. In the preferred embodiment of the present invention, the bend section 6 has a U-shape, but the bend section 6 can have other kinds of shapes such as a V-shape. The bend section 6 is adjacently connected to the shank section 4 opposite to the key-ring loop 1 so that the key-ring loop 1 is positioned at the proper depth within a slash-type pocket. The point section 7 is used to guide the hook 3 into a slash-type pocket so that the hook 3 properly engages the edge of the slash-type pocket. The point section 7 is adjacently connected to the bend section 6 opposite to the shank section 4, which allows the gap 11 to be delineated by the shank section 4, the bend section 6, and the point section 7. The edge of a slash-type pocket engages the hook 3 by traversing into the gap 11, which allows the shank section 4, the bend section 6, and the point section 7 to embrace the slash-type pocket. In addition, the bend section 6, the gap 11, and the key-ring loop 1 are linear positioned with each other along the present invention and in between the shank section 4 and the point section 7. Thus, the positioning of the key-ring loop 1 on the present invention presses those keys and other key-ring accessories against the side of a slash-type pocket so that the keys and other key ring accessories cannot move within the slash-type pocket.

Figure 6:
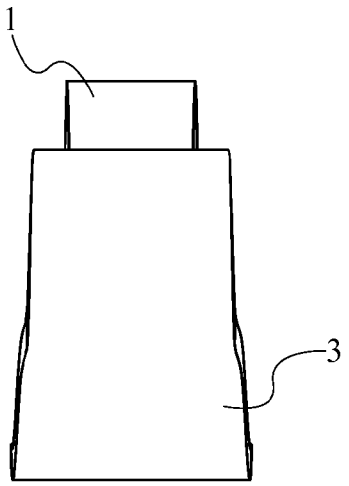
FIG. 6 is a top view of the present invention.
Figure 7:
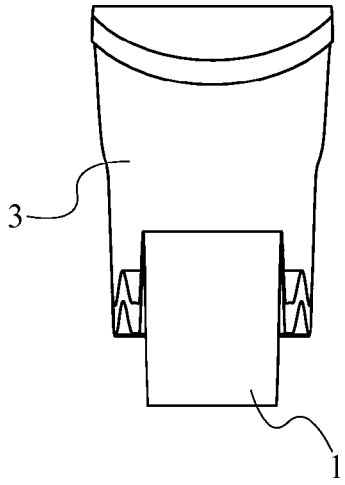
FIG. 7 is a bottom view of the present invention.

In the preferred embodiment, the present invention has a length of 70 millimeters and is made of a material that has 1.2 millimeter thickness. Also in the preferred embodiment, one strip of 18 gauge metal is used to make the key-ring loop 1, the curved bridge 2, and the hook 3, but the present invention can be made of any kind of suitable metal or plastic such as round wire, flat wire, sheet metal, cast metal, molded plastic, cast plastic, or shaped plastic. As can be seen in FIGS. 6 and 7, if the present invention is made of one strip of material, then that one strip of material increases its width along its length so that the bend section 6 is wider than the shank section 4 and the point section 7 is wider than the bend section 6. The present invention can be constructed by cutting a piece of metal into a specific shape and then bending that piece of cut metal into the shape of the present invention. Alternatively, the present invention can be constructed by forming or molding plastic into the proper shape of the present invention.

Figure 2:
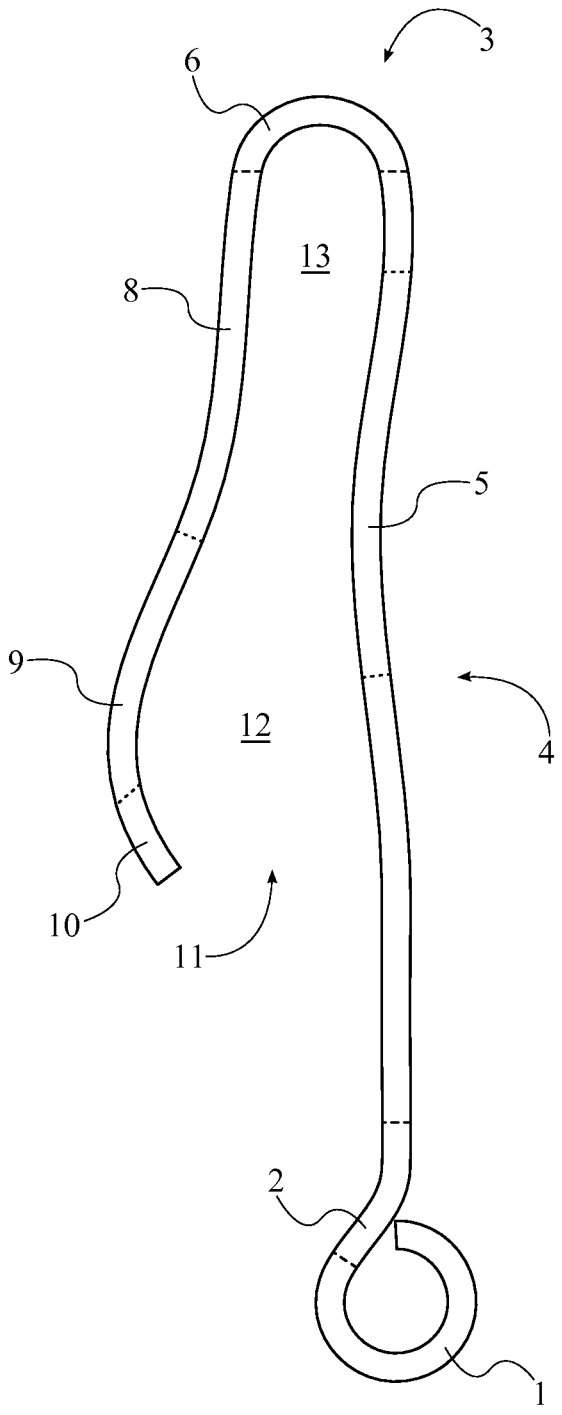
FIG. 2 is a left-side view of the present invention.
Figure 3:
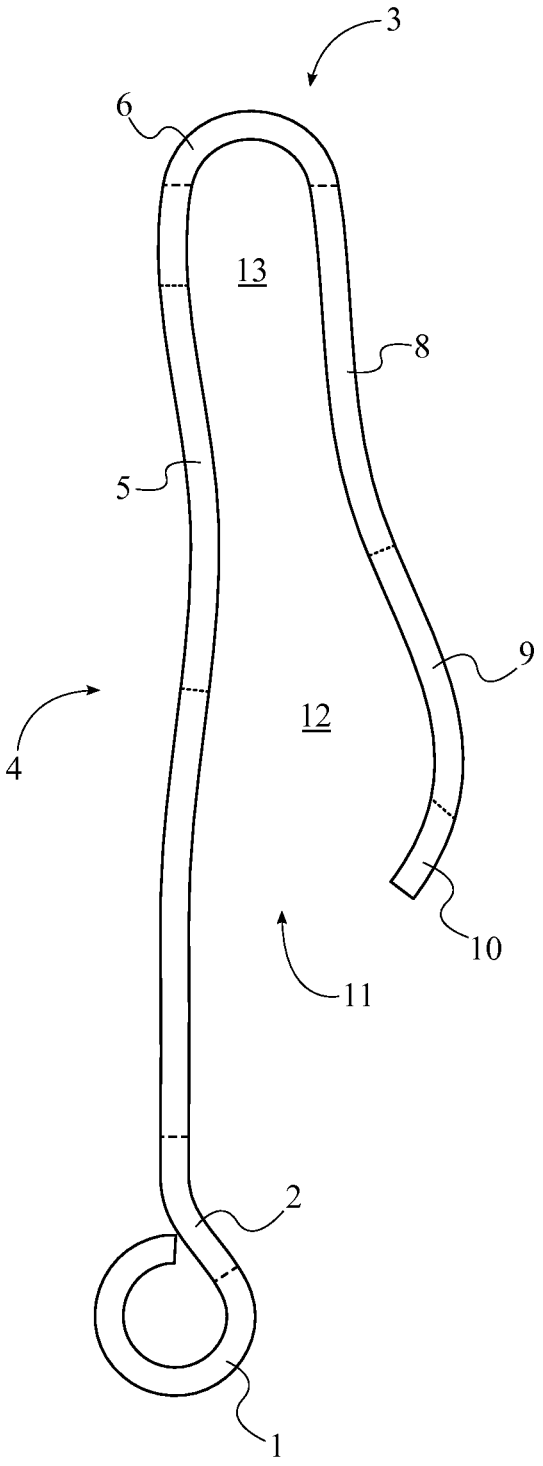
FIG. 3 is a right-side view of the present invention.

The configuration of secondary components allows the present invention to more efficiently hang keys and other key-ring accessories on the edge of a slash-type pocket. As can be seen in FIGS. 2 and 3, the shank section 4 comprises a first concave portion 5, and the point section 7 comprises a second concave portion 8, a convex portion 9, and a rounded tip 10. The first concave portion 5 bends into the gap 11. Similarly, the second concave portion 8 also bends into the gap 11. The first concave portion 5 is positioned adjacent to the second concave gap 11 so that the first concave portion 5 and the second concave portion 8 mirror each other. Both the first concave portion 5 and the second concave portion 8 are used to easily grasp the present invention with the thumb and index finger. Additionally, the components of the point portion are arranged in a specific manner. The second concave portion 8 is adjacently connected to the bend section 6, and the convex portion 9 is adjacently connected to the said second concave portion 8 opposite to the bend section 6. The arrangement of these components determines the shape of the gap 11, which allows the edge of a slash-type pocket to easily enter the gap 11, to be pinched between the first concave portion 5 and the second concave portion 8, and to be situated against the bend portion. Finally, the rounded tip 10 is adjacently connected to the convex portion 9 opposite to the second concave portion 8 and is angled towards the shank section 4. The weight on the key-ring loop 1 pulls down on the present invention when the edge of a slash-type pocket engages the gap 11, which is countered by the rounded tip 10 pressing against the slash-type pocket in the opposite direction. Consequently, the rounded tip 10 further stabilizes the present invention while the present invention hangs on the edge of a slash-type pocket. In other embodiments, the convex portion 9 can be angled parallel to the shank section 4. In addition, the rounded tip 10 also prevents the point section 7 from getting caught on anything brushing against the slash-type pocket. For example, the present invention could get caught on a car seat or other people's clothing in a crowded area. Consequently, the rounded tip 10 could prevent tears from occurring on the car seat or other people's clothing. The rounded tip 10 also prevents the hook 3 from being pulled off the edge of a slash-type pocket, which would pull the keys and the key-ring accessories out of the slash-type pocket. In the preferred embodiment, the rounded tip 10 has a radius of 3 millimeters.

Specific sections of the gap 11 are designed for specific purposes. The gap 11 comprises a wide opening 12 and a narrow space 13, which are shown in FIGS. 2 and 3. The wide opening 12 allows the edge of a slash-type pocket to be easily inserted into the gap 11. The wide opening 12 should be designed to be relatively larger than the welt thickness of any typical pocket. The wide opening 12 is delineated by the convex portion 9, the rounded tip 10, and the shank section 4 so that the convex portion 9 expands the shape of the gap 11. In the preferred embodiment, the wide opening 12 has a width of 6 millimeters. The wide opening 12 is adjacently located to the narrow space 13 so that the edge of a slash-type pocket is secured by the narrow space 13 once the edge of the slash-type pocket traverses through the wide opening 12. The narrow space 13 should be designed to be relatively similar in size to the welt thickness of any typical pocket, which allows for a snug fit between the edge of a slash-type pocket and the hook 3. The narrow space 13 is delineated by the first concave portion 5, the second concave portion 8, and the bend section 6 so that the first concave portion 5 and the second concave portion 8 taper the shape of the gap 11.

Although the invention has been explained in relation to its preferred embodiment, it is to be understood that many other possible modifications and variations can be made without departing from the spirit and scope of the invention as hereinafter claimed.

What is claimed is:

1. An apparatus for comfortably hanging keys and other key-ring accessories within a clothing pocket comprises, a key-ring loop;

a curved bridge;

a hook;

said hook comprises a shank section, a bend section, a point section, and a gap;

said shank section comprises a first concave portion;

said point section comprises a second concave portion, a convex portion, and an rounded tip;

said gap comprises a wide opening and a narrow space;

said wide opening allowing an edge of the clothing pocket to be inserted into said gap;

said key-ring loop being adjacently connected to said shank section by said curved bridge;

said bend section being adjacently connected to said shank section opposite to said key-ring loop;

said point section being adjacently connected to said bend section opposite to said shank section;

said gap being delineated by said shank section, said bend section, and said point section;

said bend section, said gap, and said key-ring loop being positioned linear with each other;

said bend section being wider than said shank section;

said point section being wider than said bend section;

said first concave portion, which is adjacently connected to said bend section, is positioned on one side of the gap and opposed to the second concave portion, which is adjacently connected to an opposed side of said bend section to delineate said narrow space between the first and second concave portions and the bend section;

said second concave portion being adjacently connected to said bend section;

said convex portion being adjacently connected to said second concave portion opposite to said bend section;

said rounded tip being adjacently connected to said convex portion opposite to said second concave portion;

said rounded tip being angled towards the shank section;

said rounded tip pressing against the pocket;

said rounded tip preventing tears from occurring on a car seat or a clothing;

said wide opening being adjacently located to said narrow space;

said wide opening being delineated by said convex portion, said rounded tip, and said shank section.

* * * * *